United States Patent [19]

Klein et al.

[11] Patent Number: 4,980,682

[45] Date of Patent: Dec. 25, 1990

[54] METHOD OF REDUCING NOISE IN A BOREHOLE ELECTROMAGNETIC TELEMETRY SYSTEM

[75] Inventors: James D. Klein, Lucas; Brian R. Spies, Plano, both of Tex.

[73] Assignee: Atlantic Richfield Company, Los Angeles, Calif.

[21] Appl. No.: 387,233

[22] Filed: Jul. 31, 1989

[51] Int. Cl.[5] ..... G01V 1/00

[52] U.S. Cl. ..... 340/854; 340/855; 175/40; 166/66; 324/351

[58] Field of Search ..... 340/853, 854, 855; 175/40; 166/250, 66; 324/333, 348, 351, 352, 355, 356, 362, 366, 369

[56] References Cited

U.S. PATENT DOCUMENTS

| | | | |
|---|---|---|---|
| 2,544,569 | 3/1951 | Silverman | 324/369 |
| 3,638,105 | 1/1972 | Schuster | 324/351 |
| 4,339,720 | 7/1982 | Halverson | 324/362 |
| 4,691,203 | 9/1987 | Rubin et al. | 340/856 |
| 4,812,766 | 3/1989 | Klein | 324/362 |
| 4,837,514 | 6/1989 | Spies | 324/336 |

*Primary Examiner*—Charles T. Jordan
*Assistant Examiner*—J. Woodrow Eldred
*Attorney, Agent, or Firm*—Geoffrey A. Mantooth

[57] ABSTRACT

A borehole telemetry system has a transmitter located in the borehole, a surface receiver, and surface signal sensors for receiving the transmitted signal. There are usually plural sources of electromagnetic noise at a well site which degrade the usefulness of the telemetry system. The method places noise sensors where the reception of noise is maximized. Simultaneous measurements are taken of the ambient noise with the noise sensors and the signal sensors. The relationship between the measurements of the noise and signal sensors is determined. The transmitted signal is then received by the signal sensors and simultaneous measurements of the ambient noise are made by the noise sensors. The noise portion of the transmitted signal as received by the signal sensors is determined from the simultaneous noise measurements and the determined relationship. A received signal having reduced noise is then produced by removing the noise portion.

10 Claims, 4 Drawing Sheets

METHOD OF REDUCING NOISE IN A BOREHOLE ELECTROMAGNETIC TELEMETRY SYSTEM

FIELD OF THE INVENTION

The present invention relates to methods of reducing noise in an electromagnetic borehole telemetry system.

BACKGROUND OF THE INVENTION

Electromagnetic telemetry systems are used to telemeter information from down in an oil or gas well borehole to surface equipment. A typical telemetry system includes a low frequency transmitter located down in the borehole and a receiver located on the surface. Instead of transmitting the electromagnetic signal over conductors in the borehole, the telemetry system transmits the signal through the earth formations surrounding the borehole.

An electromagnetic telemetry system is useful for acquiring measurement data such as pressure and temperature during fracturing or other production processes. In fracturing, the transmitter is left down in the borehole while pumps pump fluid that contains sand or some other proppant into the borehole. The pumps then pressure the fluid in the borehole to substantial pressures in order to fracture the oil bearing formations. After the formations fracture, the sand fills in the fractures, thereby increasing the permeability of the formation. Conductors conducting the transmitted signal to the surface are unable to withstand the high pressures, temperatures, and the fluids that are used in the fracturing process.

The receiver typically has plural sensors arranged on the surface of the earth in such a manner so as to maximize the reception of the electromagnetic signal. The efficacy of an electromagnetic telemetry system is determined by the signal level and the ambient noise level. Ambient noises includes telluric noise and manmade noise from powerlines and on-site machinery such as pumps and generators. These noise sources can seriously degrade the usefulness of an electromagnetic telemetry system. Thus, it is desirable to reduce the noise in an electromagnetic telemetry system as much as possible.

SUMMARY OF THE INVENTION

It is an object of the present invention to provide a method for reducing noise in an electromagnetic borehole telemetry system.

The method reduces noise in a borehole telemetry system by providing an electromagnetic telemetry system that includes a transmitter located down inside of the borehole and a receiver located on the surface. The receiver has signal sensor means. Noise sensor means is provided on the surface, with the noise sensor means being placed so as to receive the noise of interest. The noise sensor means is connected to the receiver. Simultaneous measurements are taken of the ambient noise with the noise sensor means and the signal sensor means so as to form respective first noise records from the noise sensor means and second noise records from the signal sensor means. The relationship between the first noise records and the second noise records is determined. The relationship has measurements from the noise sensors as inputs into a system and measurements from the signal sensors as outputs of the system. The relationship relates the inputs to the outputs. Simultaneous measurements are taken of the signal produced by the transmitter with the signal sensor means so as to form a signal record and ambient noise with the noise sensors means so as to form a third noise record. The signal record from the signal sensor means has a noise portion. The noise portion of the signal record is determined from the third noise records and the determined relationship. Then, the determined noise portion is removed from the signal record to obtain a signal record with reduced noise.

The relationship is an impulse response if time domain techniques are used, or a transfer function if frequency domain techniques are used. The relationship between measurements on the noise channels and measurements on the signal channels will hold over a long period of time because the ambient noise is coherent and stationary. Thus, the relationship can be used to determine or predict the noise portion in a future transmitted signal which is received by the signal sensor means.

DESCRIPTION OF PREFERRED EMBODIMENT

Figure 1:
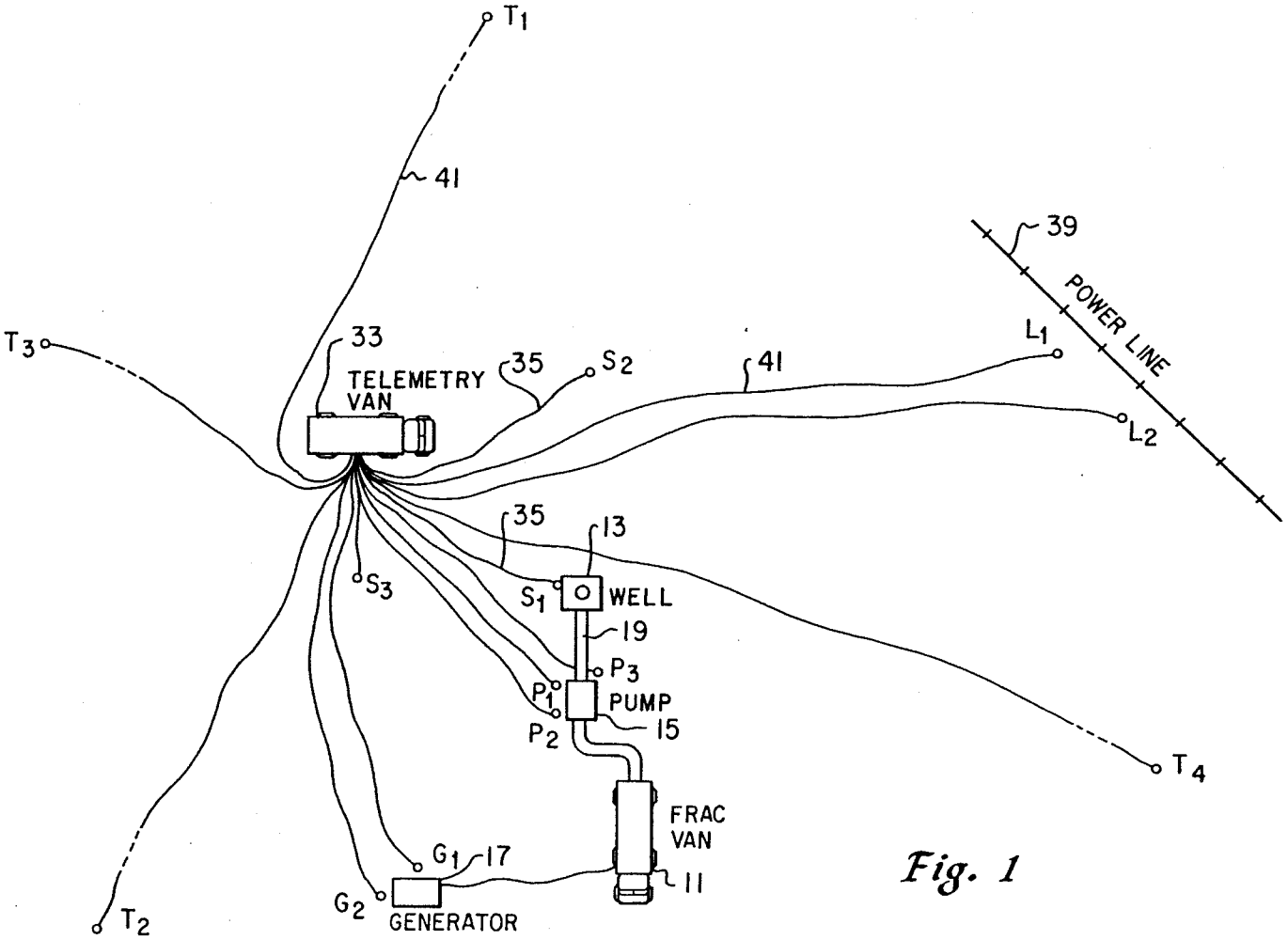
FIG. 1 is a schematic plan view of an oil well site showing a preferred embodiment of the equipment, including the sensor arrangement on the surface, which is used to practice the method of the present invention.

In FIG. 1, there is shown a schematic plan view of an oil well site with the equipment which is used to practice the method of the present invention, in accordance with a preferred embodiment. At the well site, there is fracturing equipment for use in fracturing the downhole oil bearing formations in order to enhance production. The fracturing equipment includes a frac van 11 parked near the well head 13, a pump 15, and a generator 17. The pump 15 is connected to the well head 13 by a hose 19. The generator 17 provides electrical power to the fracturing equipment and is typically located at some distance from the well head 13.

Figure 3:
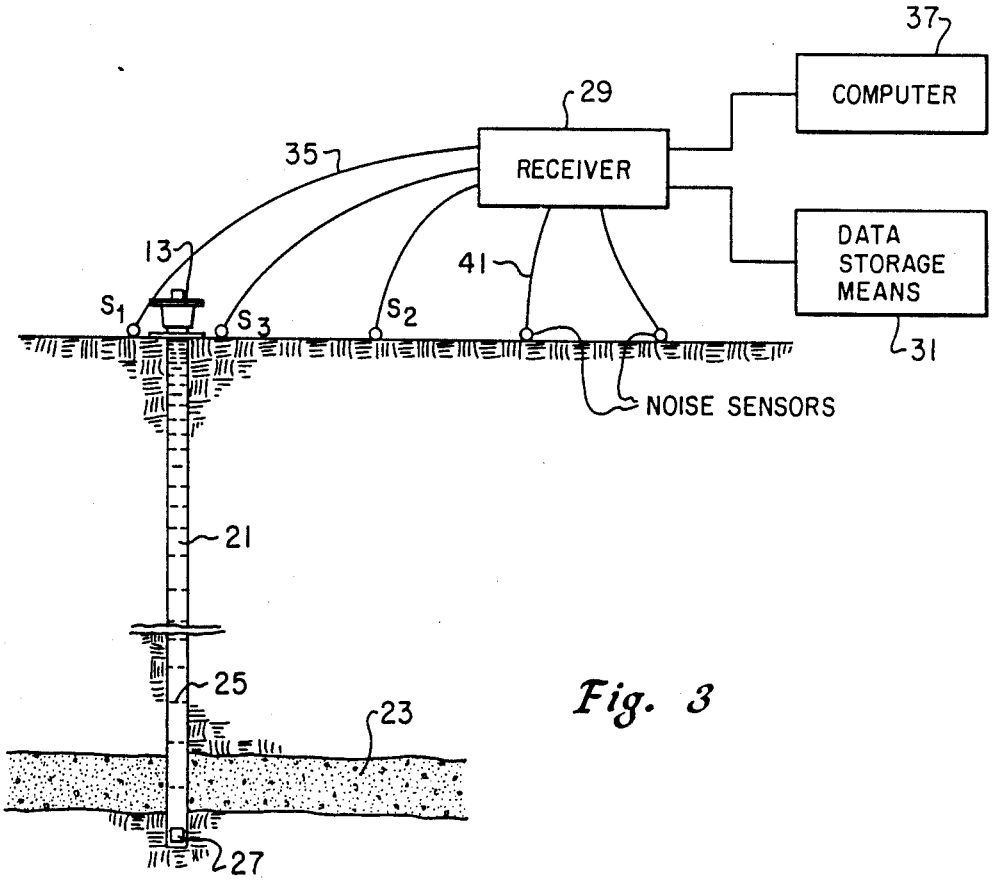
FIG. 3 is a schematic cross-sectional view of a well borehole, showing the preferred embodiment of the equipment set up which is used to practice the method of the present invention.

In fracturing, a fluid that contains sand or some other proppant is pumped down into the borehole 21 (see FIGS. 1 and 3). The pump 15 pressurizes the fluid to a sufficiently high pressure to fracture the oil bearing formation 23. During the fracturing process, it is desirable to know the temperature and pressure of the borehole fluid 25 at the oil bearing formation 23, in order to achieve better control over the fracturing process.

An electromagnetic telemetry system is employed to telemeter information on temperature and pressure to the surface during the fracturing process. Referring to FIGS. 1 and 3, the conventional electromagnetic telemetry system includes a transmitter 27, a receiver 29, signal sensors $S_1$, $S_2$, $S_3$, and data storage means 31. There are various types of electromagnetic telemetry systems in use. For example, one type of system transmits at a fixed frequency between 2–20 Hz. The intelligence (i.e. transmitted information) is incorporated into phase changes in the signal. The noise reduction method of the present invention can be used with any type of electromagnetic telemetry system. Furthermore, the noise reduction method of the present invention can be used with telemetry system applications other than fracturing processes.

The transmitter 27 is positioned downhole before the pump 15 is connected to the well head 13. The receiver 29, the signal sensors $S_1$, $S_2$, $S_3$, and data storage means 31 are located on the surface. The receiver 29 and the data storage means 31 are located in a telemetry van 33 located near the well head 13. The receiver 29 provides analog filtering of the received signals wherein the signal bandwidth of interest (typically 2–20 Hz.) is passed. The receiver 29 also amplifies and samples the received signals for purposes of subsequent processing. The signal sensors $S_1$, $S_2$, $S_3$ are located near the well head 13. The equipment setup of FIG. 1 shows three signal sensors $S_1$, $S_2$, $S_3$. One sensor $S_1$ is typically located at the well head 13, with the other sensors $S_2$, $S_3$ located radially outward from the first sensor $S_1$. The number and location of signal sensors are typically determined empirically so as to obtain the best possible signal-to-noise ratio. There are two signal channels 43 in the setup of FIG. 1; $S_1$–$S_2$ and $S_{1-S3}$ (see FIG. 2). The signal sensors are connected to the receiver 29 by cables 35. The type of sensors used may be any one of various possibilities. These possibilities include electrodes, which measure a voltage difference, magnetometers, which measure a magnetic field, and induction coils, which measure the time rate of change of a magnetic field.

Figure 4:
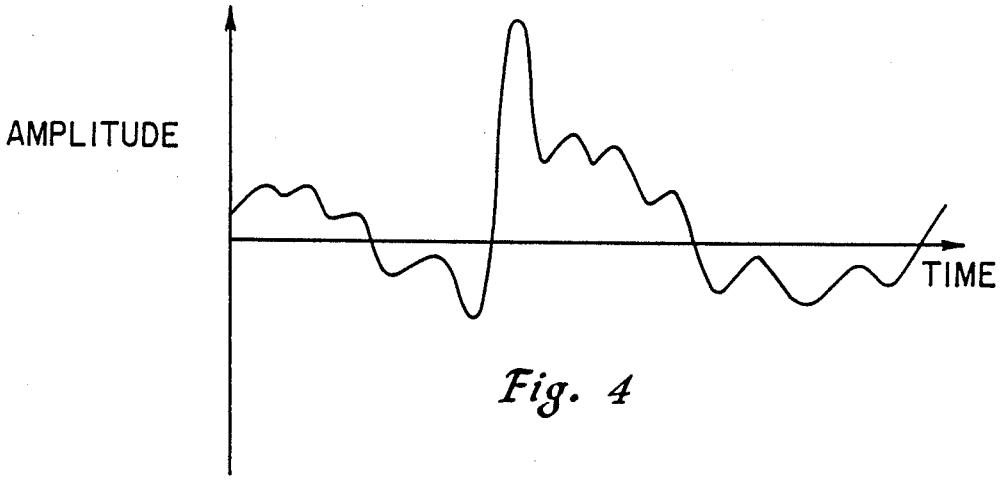
FIG. 4 is a graph showing a first noise record, which is made up of electromagnetic noise produced by the pump, as measured on the $P_1$–$P_2$ noise channel.

In addition to the electromagnetic telemetry system, other equipment for use in the noise reduction method of the present invention includes plural noise sensors and a computer 37. At the well site, there is ambient electromagnetic noise which is typically generated by plural sources. The major sources of noise around the well site are usually easily identifiable and thus can be monitored. Major sources of noise include a powerline 39 located near the well site, the pump 15, the generator 17, and natural telluric noise. Powerlines produce low frequency noise (1–20 Hz.) resulting from low frequency components of switching transients and load changes; pumps produce noise in the form of periodic spikes (see FIG. 4); generators produce rough square waves with harmonics; and telluric noise is generally wide band. These noise sources produce coherent noise. Each identified noise source is monitored by noise sensors and their associated noise channels 45, which are connected as inputs into the receiver 29. Each noise channel is served by one or two noise sensors, depending on the type of sensor used. For electrode-type noise sensors, two noise sensors are required for each channel, whereas for magnetometer-type noise sensors, only one noise sensor is required per channel. The equipment setup described hereinafter uses electrode-type noise sensors. The noise sensors are placed adjacent to the noise source. The number and location of noise sensors about a noise source is determined empirically to obtain the lowest possible signal-to-noise ratio. Thus, the noise sensors are placed relative to a noise source to maximize the noise signal from the associated noise source and minimize the signal from the transmitter 27 and from other noise sources. Noise sensors $L_1$, $L_2$ are placed adjacent to the powerline 39, and form an $L_1$–$L_2$ noise channel (see FIG. 2). Noise sensors $P_1$, $P_2$, $P_3$ are placed adjacent to the pump 15, and form a $P_1$–$P_2$ noise channel and a $P_1$–$P_3$ noise channel. Noise sensors $G_1$, $G_2$ are placed adjacent to the generator 17 and form a $G_1$–$G_2$ noise channel. Noise sensors $T_1$, $T_2$, $T_3$, $T_4$ are positioned away from the well head 13 to measure telluric noise. Respective noise channels $T_1$–$T_2$ and $T_3$–$T_4$ are formed, with noise sensors $T_1$, $T_2$ being located equidistantly from the well head 13 and noise sensors $T_3$, $T_4$ being located equidistantly from the well head. Cables 41 connect the noise sensors to the receiver 29. The receiver 29 is connected to the computer 37, which allows real time processing of the transmitted signals to provide information on temperature and pressure during the fracturing process.

With the equipment set up, the transmitter 27 is turned off, the pump 15 and the generator 17 are turned on, and time series measurements are taken of the ambient noise, as received by the signal channels 43 and the noise channels 45. The signal and noise channels 43, 45 are measured simultaneously, with each of the noise channels 45 producing a respective first noise record and each of the signal channels 43 producing a respective second noise record. The noise sensors for a particular noise channel measure primarily the noise produced by the associated noise source. Thus, for example, in FIG. 4, which shows a first noise record made up of the measurements of the $P_1$–$P_2$ noise channel, the pump noise predominates. The noise produced by the noise sources also appears on the signal channels Thus, the second noise records, which are made from the measurements from the signal channels 43, are made up of noise from the noise sources (see FIG. 5 which shows the pump noise on the $S_1$–$S_2$ signal channel; for clarity, only the pump noise is shown, the other noises are not shown). The ambient noise is measured for one to five minutes.

Figure 2:
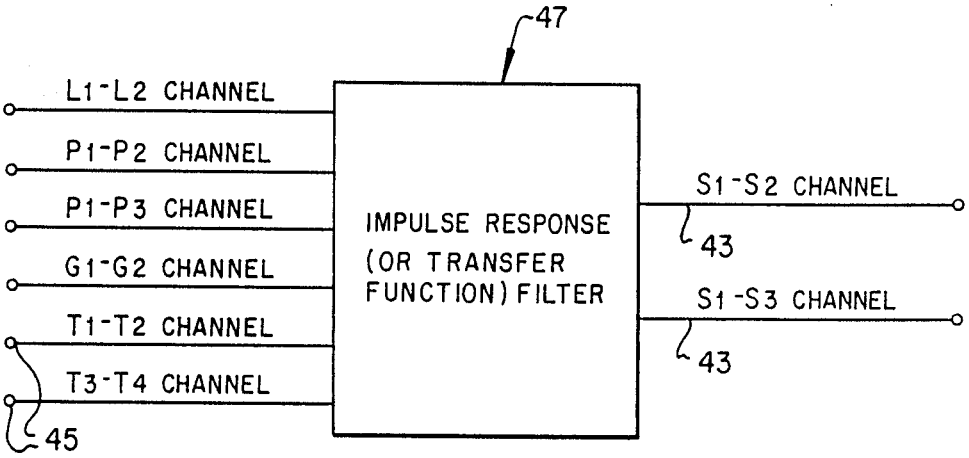
FIG. 2 is a schematic diagram showing the relationship between the noise channels and the signal channels that is used in the method of the present invention.

The relationship between the first noise records and the second noise records (or put another way, the relationship between the ambient noise measured on the noise channels and the ambient noise measured on the signal channels) is determined using generalized inverse methods such as a minimum least squares method or a multi-channel adaptive filtering method. The relationship is determined by determining the impulse response 47 (or transfer function if frequency domain techniques are used) between the first and second noise records. The computer processes the first and second noise records using an inverse method to determine the impulse response. The impulse response (see FIG. 6) has filter coefficients and can be thought of as a filter that relates the signals (whether the signals are ambient noise or the transmitted signal containing the intelligence) on the noise channels to the signals on the signal channels. The noise measured on the noise channels can be related to the noise measured on the signal channels because the noise is coherent. Referring to FIG. 2, which shows schematically the relationship between the noise channels 45 and the signal channels 43, the noise channels 45 are inputs into the impulse response 47, while the signal channels 43 are outputs from the impulse response 47. Thus, the impulse response 47 relates the inputs to the outputs. The inverse methods are applicable to an arbitrary number of noise channels 45 and an arbitrary number of signal channels 43. Thus, there can be any number of noise channels and signal channels. The number of noise channels is typically determined by the number and type of identified noise sources.

Figure 7:
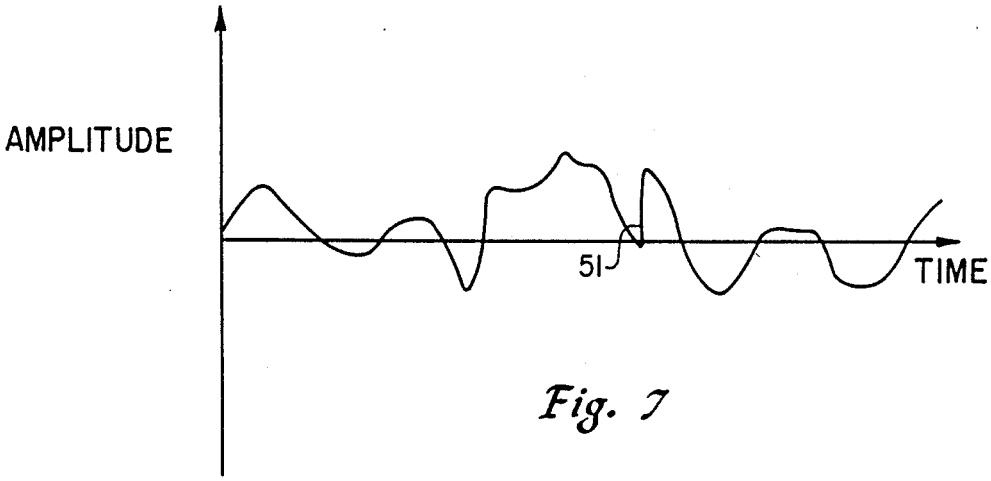
FIG. 7 is a graph showing a signal record which includes a signal from the transmitter and the pump noise, as measured on the $S_1$–$S_2$ signal channel.

Next, the transmitter 27 is turned on and produces a transmitted signal which contains intelligence on the downhole temperature and pressure. The receiver 29 receives the transmitted signal with the signal sensors $S_1$, $S_2$, $S_3$ and on the respective signal channels 43 while simultaneously measuring the ambient noise on the noise channels 45. The transmitted signal, as received on the signal channels, forms respective signal records (see FIG. 7). The ambient noise as received on the noise channels forms respective third noise records (such as the first noise record shown in FIG. 4).

Each signal record (see FIG. 7) has a transmitted signal portion, which contains intelligence 51, and a noise portion. The noise portion contains noise from the identified noise sources the powerline 39, the pump 15, the generator 17, and telluric noise. The noise portion of each signal record can be determined and subtracted from the signal record.

Figure 5:
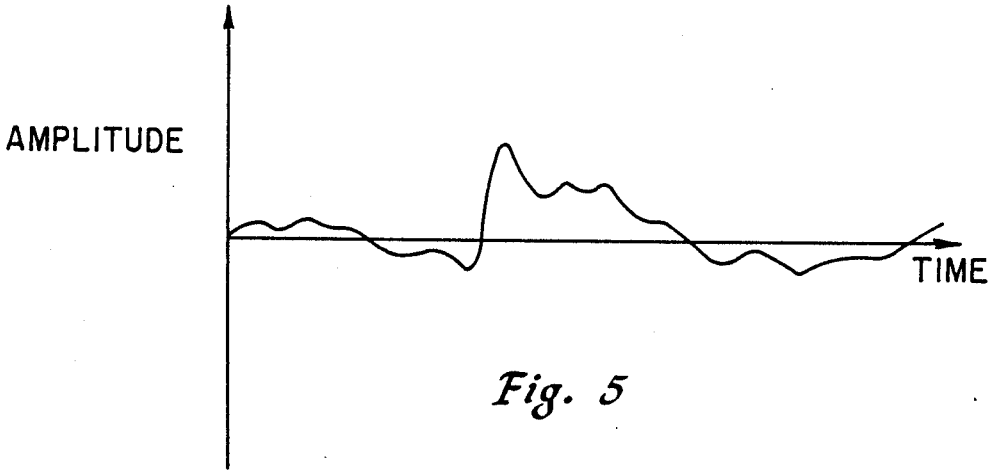
FIG. 5 is a graph showing a second noise record, which is made up of electromagnetic noise produced by the pump, as measured on the $S_1$–$S_2$ signal channel.
Figure 6:
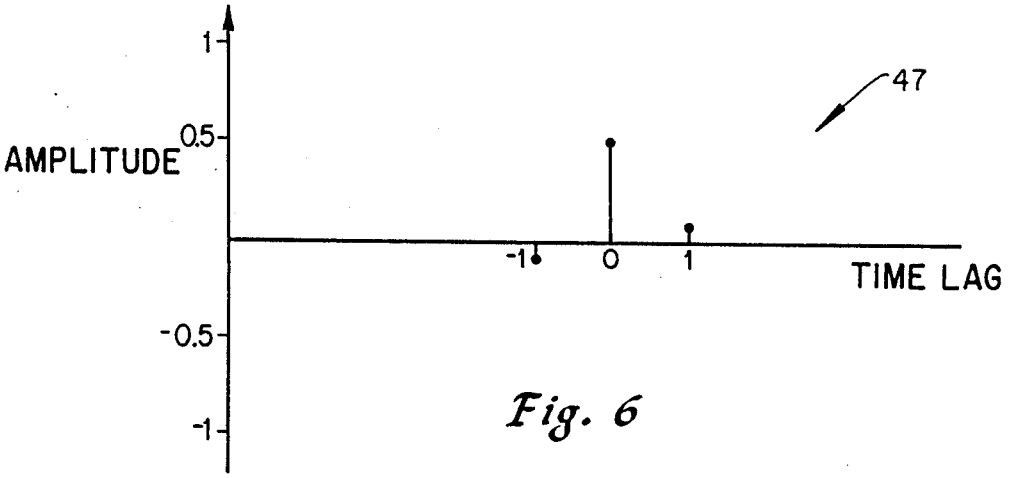
FIG. 6 is a graph showing the impulse response as determined from the graphs of FIGS. 4 and 5.

To determine the noise portion of each signal record, the third noise records are convolved with the impulse response 47 (see FIG. 6). The convolutions are performed by the computer 37. Thus, as shown in FIG. 2, the third noise records as measured by the noise channels 45 are inputs into the impulse response 47 and the outputs are the noise portions (such as is shown in FIG. 5) on the signal channels.

Figure 8:
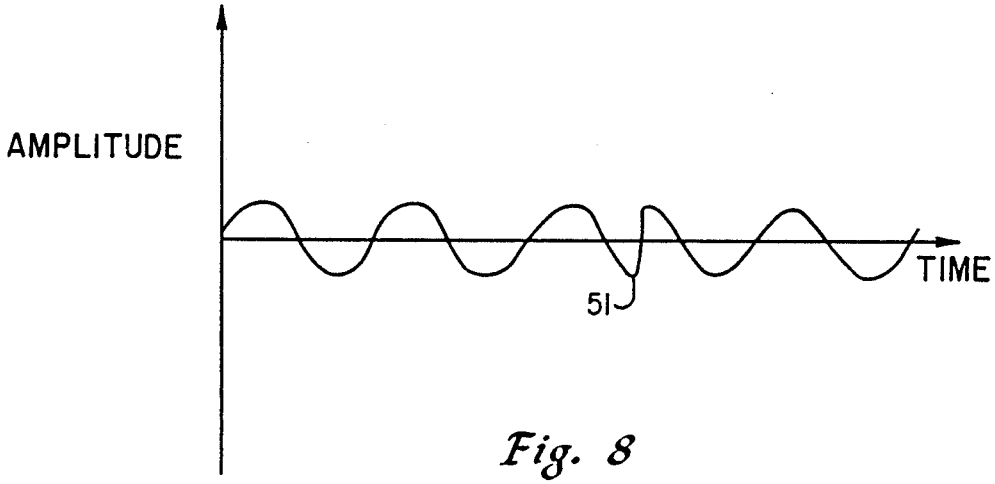
FIG. 8 is a graph showing the signal record of FIG. 7, after processing, wherein the pump noise has been removed.

After the noise portions of the signal records are determined, they are removed from the signal records by conventional subtraction techniques. The end results are processed signal records (see FIG. 8) that have reduced noise with a consequent increase in the signal-to-noise ratio of the signal records.

Because the noise recorded on the noise channels is coherent with noise recorded on the signal channels, the filter coefficients of the impulse response 47 are stationary with respect to time. That is, once an impulse response has been determined, it will remain accurate for several hours. The impulse response can be updated throughout the day to ensure the best possible accuracy Furthermore, the impulse response can be updated during telemetry operations wherein the receiver is receiving the transmitted signal. Such updating simultaneously with telemetering can occur if the noise as measured by the noise sensors is much greater than the transmitted signal as measured by the noise sensors and the signal is uncorrelated with the noise. As an example, if the noise signals are ten times greater than the transmitted signals as measured by the noise sensors, then the impulse response can be accurately updated.

Although the method of the present invention has been described as using an impulse response to relate measurements on the noise channels 45 to measurements on the signal channels 43, the same relationship can be achieved using frequency domain techniques and determining the transfer function.

The foregoing disclosure and the showing made in the drawings are merely illustrative of the principles of this invention and are not to be interpreted in a limiting sense.

We claim:

1. A method for reducing noise in a borehole telemetry system, comprising the steps of:

(a) providing an electromagnetic telemetry system comprising a transmitter located inside of said borehole and a receiver located on the surface, said receiver having signal sensor means;

(b) providing noise sensor means on the surface, said noise sensor means being placed so as to receive the noise of interest, said noise sensor means being connected with said receiver;

(c) simultaneously measuring ambient electromagnetic noise with said noise sensor means and said signal sensor means so as to form respective first noise records from said noise sensor means and second noise records from said signal sensor means;

(d) determining the relationship between said first noise records and said second noise records, said relationship having measurements from said noise sensors as inputs into a system and measurements from said signal sensors as outputs of said system, said relationship relating said inputs to said outputs;

(e) simultaneously measuring a signal produced by said transmitter with said signal sensor means so as to form a signal record and measuring ambient electromagnetic noise with said noise sensor means so as to form a third noise record, said signal record from said signal sensor means having a noise portion;

(f) determining from said third noise record and said relationship the noise portion of said signal record, wherein said third noise record is an input into said system;

(g) removing said determined noise portion from said signal record to obtain a signal record with reduced noise.

2. A method for reducing electromagnetic noise in a borehole telemetry system, said noise being produced by identified noise sources, comprising the steps of:

(a) providing an electromagnetic telemetry system comprising a transmitter located inside of said borehole and a receiver located on the surface, said receiver having signal sensor means located adjacent to the surface of the earth;

(b) providing noise sensor means, said noise sensor means being placed so as to receive the noise from said respective identifiable noise sources, said noise sensor means being connected with said receiver;

(c) measuring said noise from said noise sources with said noise sensor means and positioning said noise sensor means relative to said noise sources so as to obtain maximum noise measurements;

(d) simultaneously measuring ambient noise with said noise sensor means and said signal sensor means so as to form respective first noise records from said noise sensor means and second noise records from said signal sensor means;

(e) determining the relationship between said first noise records and said second noise records, said relationship having measurements from said noise sensors as inputs into a system and measurements from said signal sensors as outputs of said system, said relationship relating said inputs to said outputs;

(f) simultaneously measuring a signal produced by said transmitter with said signal sensor means so as to form a signal record and measuring ambient noise with said noise sensor means so as to form a third noise record, said signal record from said signal sensor means having a noise portion;

(g) determining from said third noise records and said relationship the noise portion of said signal record, wherein said third noise record is an input into said system;

(h) removing said determined noise portion from said signal record to obtain a signal record with reduced noise.

3. The method of claim 2 wherein said relationship comprises an impulse response between said noise sensor means and said signal sensor means, wherein said relationship is determined using inverse methods.

4. The method of claim 2 wherein said relationship comprises a transfer function between said noise sensor means and said signal sensor means.

5. A method for reducing noise in a borehole telemetry system, comprising the steps of:

(a) providing an electromagnetic telemetry system comprising a transmitter located inside of said borehole and a receiver located on the surface, said receiver having signal sensor means;

(b) identifying sources of ambient electromagnetic noise as received by said signal sensor means;

(c) providing noise sensor means that are placed so as to receive the noise from said respective identified noise sources, said noise sensor means being placed so as to minimize the signal-to-noise ratio, said noise sensor means being connected with said receiver;

(d) simultaneously receiving said ambient noise with said noise sensor means and said signal sensor means so as to form respective first noise records from said noise sensor means and second noise records from said signal sensor means;

(e) determining the relationship between the first noise records as received by said noise sensor means and the second noise records as received by said signal sensor means;

(f) simultaneously receiving a signal produced by said transmitter with said signal means so as to form a signal record and receiving said ambient noise with said noise sensor means so as to form a third noise record, said signal record having a noise portion;

(g) determining the noise portion of said signal record from said third noise record and said determined relationship;

(h) removing said determined noise portion from said signal record.

6. The method of claim 5 wherein said relationship is determined from noise records obtained at a first time, further comprising the step of redetermining said relationship from said noise records obtained at times subsequent to said first time.

7. The method of claim 5 wherein said noise sources comprise a pump and a generator located on the surface near said borehole.

8. The method of claim 5 wherein said noise sources comprise telluric noise.

9. The method of claim 5 wherein said noise sources comprise powerline noise.

10. The method of claim 5 wherein said noise sources comprise a pump and a generator located on the surface near said borehole, telluric noise and powerline noise.

* * * * *